United States Patent [19]

Hartmannsgruber et al.

[11] 4,161,862

[45] Jul. 24, 1979

[54] DRAW ROLL DRIVE ARRANGEMENT

[75] Inventors: Max Hartmannsgruber, Kirchheim; Günter Schulz; Konrad Klein, both of Ebersbach; Horst Wolf, Albershausen, all of Fed. Rep. of Germany

[73] Assignee: Zinser Textilmaschinen GmbH, Ebersbach, Fed. Rep. of Germany

[21] Appl. No.: 832,701

[22] Filed: Sep. 12, 1977

[30] Foreign Application Priority Data

Sep. 15, 1976 [DE] Fed. Rep. of Germany ..... 2641434

[51] Int. Cl.[2] ..... D01H 1/22

[52] U.S. Cl. ..... 57/92; 19/293; 57/100; 57/102

[58] Field of Search ..... 57/1 R, 36, 92, 97, 57/100, 102; 19/293

[56] References Cited

U.S. PATENT DOCUMENTS

| | | | |
|---|---|---|---|
| 2,404,218 | 7/1946 | Crossley | 57/36 X |
| 2,875,645 | 3/1959 | Keyser | 57/102 X |
| 3,782,097 | 1/1974 | Nakamura et al. | 57/102 X |

*Primary Examiner*—Charles Gorenstein
*Attorney, Agent, or Firm*—Edwin E. Greigg

[57] ABSTRACT

A long spinning machine, preferably a ring spinning machine, with a plurality of drawing means, which serve to draw the fiber strands with the drawing means being arranged adjacent to each other and extending lengthwise of the machine the drawing lower rollers of the drawing means formed by a plurality of long roller lines positively connected together at one point by drive gear transmissions which provide predetermined rpm ratios between the roller lines with some of the roller lines connected together by additional drive gear transmission at least at one additional point spaced from the one point to eliminate or substantially reduce torsion in the roller lines.

21 Claims, 3 Drawing Figures

DRAW ROLL DRIVE ARRANGEMENT

BACKGROUND OF THE INVENTION

The spinning machines to which this invention relates are preferably of the type known as "ring spinning machines", however, the invention can be used to advantage on other long spinning machines that have drawing frames, such as cannister spinning machines, flyers or the like, that have several lower rollers.

Rotatably supported upper rollers are pressed onto the driven lower rollers of the drawing frame of such spinning machines, and by means of the varying circumferential speeds of the lower rollers fiber strands supplied thereto and which are squeezed between the upper and lower rollers are drawn therethrough. The lower rollers of the drawing frame which are arranged lengthwise of the machine are formed by very long roller lines, which extend along all of the drawing frames. It is common practice to drive the roller lines that form the output lower rollers of this drawing frame at both of its ends by a motor, and further to drive the other roller lines on the machine by means of this roller line by step-down gear transmissions at stepped-down, lower rpm's. The ends of these roller lines opposite the drive side thereof have ended up free in the conventional spinning machines i.e., they have never been driven at each end. Because of the great length of the roller lines it is thus impossible to prevent them from twisting during operation, with the torsion on the free ends of the rollers being caused to increase from one line to the next and consequently being the greatest at the last drawing frame. The torsion of the roller lines is caused by the drive power which is transferred by these lines to the upper rollers, and by the friction in the numerous roller line supports.

The torsion in the roller lines causes draw malfunctions and has therefore disadvantageous effects on the quality of the produced yarns or unfinished yarns. Such torsion can lead to torsion variations in the bottom roller lines and as a consequence the uniform operation of the drawing process is prevented and periodic thickness variations of the yarn or unfinished yarn can thus result, from such machine operation which in extreme cases can lead to unusable yarns or unfinished yarns. The resulting average values of the torsion in the roller lines during operation of the machine regardless of whether they are overlapped by torsion variations or not, can be extremely disadvantageous, especially in connection with periodic idleness of the machine, which is necessary occasionally to exchange the empty spools or cartridges. Th torsions present during operation of the machine decay when the machine is idle and can thereby cause draw malfunctions and naturally this will lead to thread breaks when the machine is again started. Thus the next-to-last roller line in the thread supply feeding device of a drawing frame has a higher torsion than the roller line which forms the lower supply roller located on the output side of the drawing frame, which can lead to a temporary interruption of the thread feed to the supply roller pairs and thereby ultimately to thread breaks.

The drawing malfunctions caused by torsion and/or torsion fluctuations of the roller lines have been solved in the past by limiting the length of the spinning machine and by using roller lines of the greatest possible diameter. The diameter of the roller lines depends, however, on technical spinning factors, and one cannot enlarge them too much for reasons of space. It is also desirable in many cases to diminish the diameter of the roller lines, in order to be able to spin fiber strands with a shorter stacking length, which accordingly require a smaller field of distortion, without having to have a shorter spinning machine for this purpose. It would be much more desirable, on the other hand, to be able to lengthen the spinning machine, since the economy of a spinning machine increases with the increased number of its drawing frames.

OBJECT AND SUMMARY OF THE INVENTION

It is therefore the principal object of this invention, to overcome the drawing malfunctions caused by the torsion of the roller lines of the drawing frame, in a structurally simple, reliable manner, so that the spinning machine is longer than conventional known machines with a significant increase in the number of its drawing means and/or which can lower the number of drawing malfunctions caused by the torsion of the roller lines.

Another object of this invention is to provide a spinning machine in which at least two of the roller lines of the drawing system that are arranged lengthwise of the machine are associated with another by gear transmissions that have step up and step down ratios.

Still another object of the invention is to provide the improved spinning machine with gear transmissions that are positioned substantially medially of the drawing system.

A further object of the invention is to provide the spinning machine with a booster motor that is adapted to exert torque on the roller line at a distance removed from the gear transmission assembly to reduce torsion.

Yet another object of the invention is to increase the length of the drawing area of the spinning machine and to decrease the drawing malfunctions naturally caused by torsion of the roller lines as well as decrease the diameter of the roller lines.

Numerous other advantages result from the use of this invention e.g. it is extremely economical because it has not been conceivable heretofore to construct spinning machines with long roller lines.

Especially high economical advantages result, when one constructs the spinning machine significantly longer than has been common previously. Also by such an assembly as taught herein the high fixed costs of the drive and control elements of the spinning machine are then divided over a significantly greater number of drawing frames, for example, double the number. Further, by having the gear transmission associated with the ends of the roller lines lengthening of the drawing area of the machine can be more readily achieved up to several times the lengths conceivable heretofore, depending on the arrangement of the gear drive.

Normally it is expedient to positively connect all roller lines at one point of each along the length of the machine adjacent to an outer drawing means or between two drawing means by means of gear drives. In many cases in fact, it is sufficient to connect only two roller lines, preferably those that border on the drawing field with the highest draft, on one additional point by another special gear drive, so that in case one or more other roller lines are present, preferably a roller line on the input side of a pre-draw region these other roller lines are paired with only a single gear drive. Indeed, torsion or torsion fluctuations can cause more disturbance when the draft is greater in the draw region which they border. And this does not even touch on the fact that it is naturally optimal and therefore advantageous because of the additional expenses that do not constitute the greater percentage of the total price of the spinning machine, if all roller lines on the length of the machine involved are connected with each other by gear drive means at at least two points spaced from each other by a significant distance.

The drive of the roller lines on one or both sides of the machine can be accomplished in a known manner by a single drive motor, which can include an electric motor employed only for these roller lines or an electric motor employed also for the spindles and/or other machine elements, such as the rail ring, spool stand and the like.

Especially with extremely long spinning machines it can be advantageous to provide two motors for the drive of the roller lines, which drive the roller line arranged at the drawing system output at two points greatly separated from each other, and thus reduce the absolute roller line torsion. One of these two motors can be less powerful than the other that is less powerful than the main drive motor e.g. this motor could be actually a booster motor. The booster motor can be an asynchronous motor or a synchronous motor, preferably a motor having a rotating magnetic field. In some instances, a non-electric motor could be provided, for example one having an hydraulic motor.

Structurally, it is especially favorable to provide gear drive means on both ends of the roller line. In many cases it can be advantageous if at least one gear drive connection of the roller line is provided between two drawing means. Thus, in this manner the torsion and torsion fluctuations of the roller lines can be even further reduced, so that among other things the spinning machine can be even longer. If, in such a case the roller lines are also connected to each other on both ends by gear transmissions, the gear transmissions located between two drawing means can engage at the middle of the roller lines. If only one end of the roller lines is connected by the gear transmission, it can be advantageous to arrange the gear transmissions located between the drawing means at a distance of approximately 0.6 to 0.7 times the length of the roller lines from the end of the roller lines that are connected together by the gear drives, since this arrangement produces a minimum of torsion. As also disclosed in detailed hereinafter the connecting of the roller lines of the side of the machine concerned by gear drives occurs exclusively approximately in the center of the roller lines, so that the torsions of the roller lines at the two outer drawing means are only about half as large as with the common one sided gear drive arrangement, thus in this way the length of the drawing means area of this novel machine can be doubled.

The drive motor in many cases can be advantageously arranged in the center of the long side of the machine near the gear transmissions, or it is also possible to have the drive motor operate on one end of a roller line, preferably that of the roller line with the highest rpm. Also, two or more drive motors can be provided. The roller lines can extend through the gear drive, but it is also possible at a greater expense to interrupt them at the point of drive.

It is also structurally simple and reliable, to produce a substantial reduction of the torsions of the roller lines driven by booster motors, with all of the resultant advantages as will be described later. Preferably each roller line would have its own booster motor. As non-electrical booster motors, one preference is hydraulic motors, also called hydromotors. Motors having a rotating magnetic field are rotational current fed asynchronous motors, which are not designed for a specific performance, but rather for a maximum torque, which they can deliver depending on their position when stopped and can remain switched on when stopped. Such motors having a rotating magnetic field are produced, for example, by SSB-Electromachines GmbH & Co. KG., Salzbergen, West Germany.

The invention will be better understood as well as further objects and advantages thereof become more apparent from the ensuing detailed description when taken in conjunction with the drawings and finally claimed.

BRIEF DESCRIPTION OF THE DRAWINGS

In the drawings several exemplary embodiments of the invention are schematically shown.

In the drawings, corresponding parts are provided with the same numerals.

DESCRIPTION OF THE PREFERRED EMBODIMENTS

Figure 1:
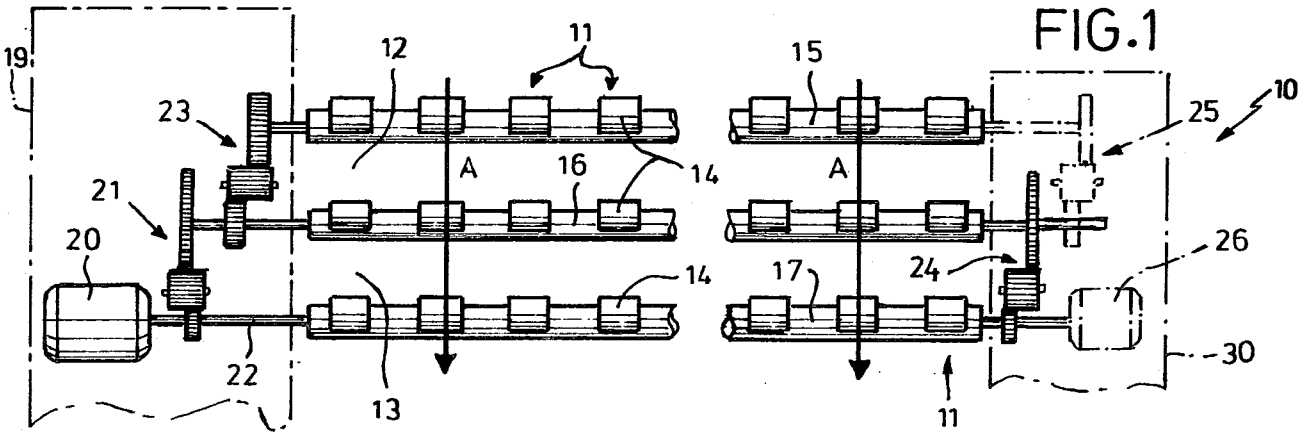
FIG. 1 is a fragmentary front elevational view of the improved spinning machine according to the first exemplary embodiment of the invention.
Figure 2:
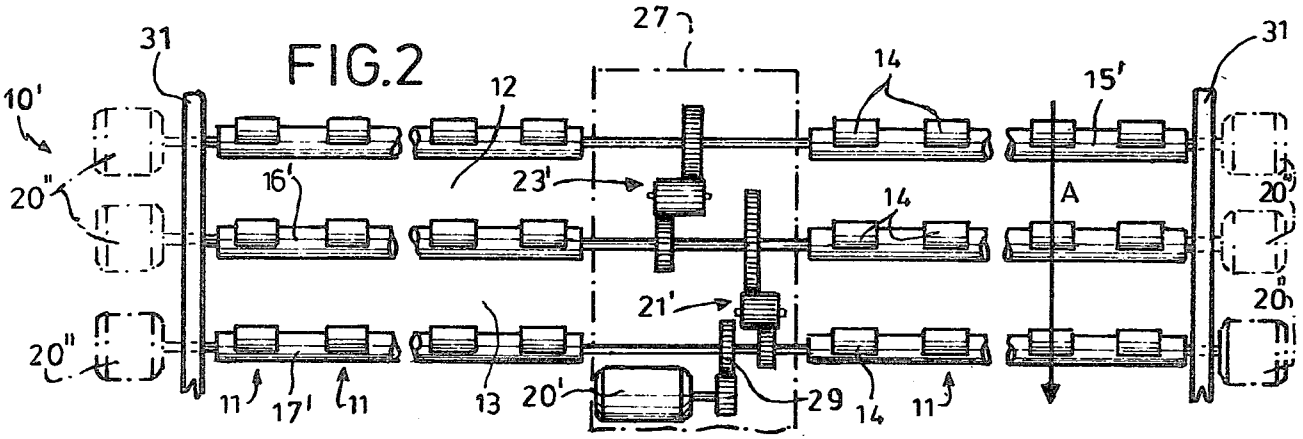
FIG. 2 is a fragmentary front elevational view of another spinning machine according to a second exemplary embodiment of the invention.
Figure 3:
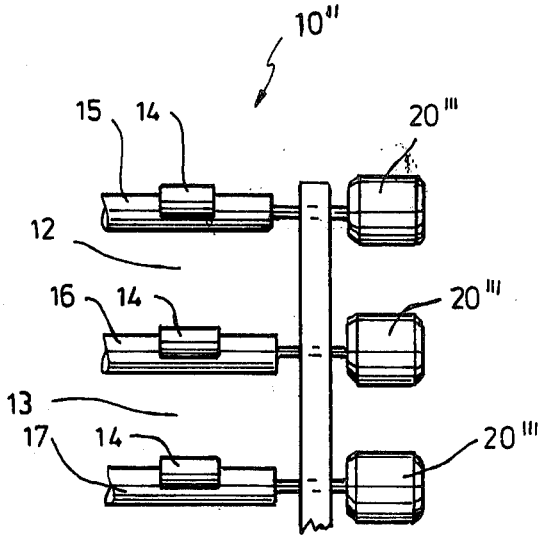
FIG. 3 is a partial fragmentary view of one side of the machine showing another embodiment according to FIG. 1.

The schematically illustrated spinning machines 10, 10', and 10'', that are shown in FIGS. 1, 2, and 3, are particularly concerned with ring spinning machines, which have about double the number of drawing means 11 arranged the length of the machine than was possible heretofore. The drawing means 11 in these exemplary embodiments have the common preliminary drawing field 12 and a main drawing field 13, through which extend in the direction of the arrow A the fiber strands to be drawn. After leaving the drawing means 11 the drawn fiber strands are twisted into yarn and wound onto a spool by means of known devices, in the case of ring spinning machines by means of runners and spindles.

The drawing means 11 have common upper roller carriers, not-shown which press the upper roller 14 onto the lower rollers formed by three roller lines 15, 16, 17 (FIGS. 1, 3 i.e. 15', 16', 17' (FIG. 2) extending along all of the drawing means on this side of the machine, in order to grip and transport the fiber strands to be drawn.

In the following description of the exemplary embodiment according to FIG. 1 the roller lines 15, 16, 17 are of the common construction.

The spinning machine according to FIG. 1 has a common drive means 19 with an electric motor 20 to drive the roller lines 15, 16, and 17. This drive motor 20, besides driving the roller lines 15, 16, 17, can also serve to drive the roller lines arranged on the other long side of the machine. The motor 20 can, if necessary, also serve to drive other machine elements, such as spindles and ring rails. The drive motor 20 directly drives the shaft 22 of the roller line 17, which is arranged at the output end of the drawing means 11, and which forms the lower feed rollers, and though the drive is direct, a transmission can be also utilized. This roller line 17 operates at a much higher rpm than the other two roller lines 15, 16, which causes only a limited drawing power in the preliminary drawing fields 12, which they in part delimit, because of the high pull in the main drawing fields 13.

On both ends of each roller line 15, 16, 17 there is a gear attached as shown, these being connected to each other by intermediate gears which engage with them, so that four gear drives 21, 23, 24, 25 are present. In this manner the left end of the roller line 17 as viewed in the drawing is positively connected with the middle roller line 16 at its drive by the gear drive 21, and this roller line 16 is positively connected with the roller line 15 at its drive by the gear drive 23. The right end of the roller lines 15, 16, 17 (as seen in FIG. 1) are also positively connected in predetermined rpm relationships by means of the gear drives 24, 25, the step-down of which correspond to those of the gear drives 21 i.e. 23. The diameter of the gears of the transmissions 21, 23, 24, 25 are not according to scale. This is also true of other details in both exemplary embodiments. Further gears can also be provided for whatever speed control is deemed necessary.

The draw malfunctions caused by the unavoidable torsions of the roller lines 15, 16, 17 are the greatest in the middle of the drawing area of the machine 10 because of the gear drives 21, 23, 24, 25, but they are only half as great as those on the right side of these roller lines 15, 16, 17 as viewed when looking at the drawings. The draw malfunctions decrease progressively from the middle of the drawing area toward both sides i.e., from drawing means to drawing means, until is is practically zero at both ends, since the roller lines 15, 16, 17 are driven by transmissions 24, 25 at the ends, where the roller lines 15, 16, 17 remain precise and uninfluenced by the torsions because of their proximity to the transmissions 24, 25. Accordingly, the draw malfunctions caused by the torsions of the roller lines 15, 16, 17 in the drawing fields 12, 13 are at most only about half as great as if the transmissions 24, 25 were not present, and one can therefore make the length of the drawing area of this machine, for example, twice as long as in a conventional, comparable machine. Because of the low draw pressure in the preliminary drawing fields 12 and the resultant low torsions in the roller lines 15, 16, it is not necessary in all instances to connect the roller lines 15, 16, as viewed in FIG. 1 by a gear transmission, so that it is possible where desired to leave out the gear transmission 25. It can be also advantageous to provide a second drive motor 26, as shown by the broken lines, which motor would drive the roller lines 17, as viewed in FIG. 1, whereby the torsions of the roller lines 15, 16, 17 become substantially smaller, so that the draw malfunctions caused by torsion in these roller lines can be even further reduced with the attendant advantages. This also causes a substantial decrease in the load on these roller lines, which is very important. The motor 26 and the transmissions 24, 25 are arranged in a housing, shown by the broken line.

In the exemplary embodiment of the invention according to FIG. 2, the lower rollers of the drawing system 11 formed by the roller lines 15', 16', and 17' are connected with each other in the middle of the drawing area of this machine 10' by means of gear drives 21', 23'.

In the area of the transmissions 21', 23', arranged in the housing 27 shown by the broken line, the diameters of the roller lines 15', 16', 17' are smaller.

Although it is normally advantageous for structural reasons to provide only the transmissions 21', 23' in such an embodiment, in extreme cases the outer ends of the roller lines 15', 16', and 17' can be connected with each other by gear drives in a manner not shown, so that the torsion-dependent draw malfunctions can be reduced even further, or the spinning machine can be lengthed even more.

The drive of these draw roller lines 15', 16', 17' in this embodiment of the invention is accomplished by a single drive motor 20', which preferably can simultaneously be the main drive motor of the spinning machine 10' and perhaps also can be arranged at other positions on the spinning machine, for example, on one end of the machine, driving a gear 29 arranged on the roller line 17. In order to decrease the torsion of the roller lines 15', 16', and 17' even further, their outer ends can be connected with additional booster drive motors 20'', which are not as powerful as the main drive motor 20'.

The outer ends of the roller lines 15', 16', 17', are supported in support plates 31. Of course, the long roller lines in both FIGS. 1 and 2 are supported by such support plates at several points along their lengths.

The spinning machine 10'', shown schematically in FIG. 3, is a further variation of the spinning machine 10 of FIG. 1. In this embodiment the machine differs from that of FIG. 1 in that a special booster motor 20''', instead of the gear transmissions 24 and 25, is arranged on each of the ends of the roller lines 15, 16, 17 opposite the main drive motor 20 and gear transmissions 21, 23 are not further shown in FIG. 3. The roller lines 15, 16, 17 are thus connected with each other on the left as viewed in the drawing in FIG. 1 by gear transmissions and are driven by a main drive motor. Thus, besides the main drive motor, there are less powerful booster motors 20''' present for each roller line 15, 16, 17, which booster motors drive the right side of the roller lines 15, 16, 17 (as viewed in the drawing) independently of one another, in order to decrease the torsions of these roller lines 15, 16, 17 and thereby also decrease the draw malfunctions of the drawing system caused by such torsions. Their torque must thus be selected so that the main drive motor exerts a driving torque on the roller lines 15, 16, 17 which can preferably correspond to the torque of the respective booster motors 20'''. In this preferred embodiment, the drive shaft of each booster motor 20''' is directly connected to its corresponding roller line end in such a manner as to rotate with it, yet under certain circumstances a transmission also can be interposed. These booster motors 20''' are preferably electric motors. Either synchronous or asynchronous motors would be acceptable, but preferably a motor having a rotating magnetic field would be provided. It is also conceivable, that non-electrical motors 20''' could be provided, for example, hydraulic motors.

The purpose of the booster motors 20''' of FIG. 3 is the same as that of the booster motors 20'' and described in connection with the embodiment according to FIG. 2.

The spinning machine according to FIG. 3 has the same advantages as the spinning machine according to the FIGS. 1 and 2.

In the spinning machine according to FIG. 3, the gear transmissions connecting the roller lines 15, 16, 17, are arranged on the ends of the roller lines opposite the ends which are driven by the booster motors 20''', but under certain circumstances they could have a different arrangement, for example, they could be located at about ⅔ of the roller line length from the end of roller line shown in FIG. 3, whereby the torsions would be even further reduced.

In some instances it can be sufficient not to provide all of the roller lines with such booster motors 20''', but rather only one or two roller lines, preferably the roller lines 16 and 17. It is also possible and in many cases advantageous, to allow these booster motors 20''' to engage not on an end of the roller lines 15, 16, 17, but rather between two drawing means in operating connection with the concerned roller lines, and to do it preferably at places as discussed above in connection with the additional gear transmissions, that is, preferably at a distance of about ⅔ of the roller line length from the roller line ends connected with each other by the gear transmissions. In some cases each of the roller lines concerned advantageously can be arranged with two or more such booster motors, which engage the roller line at substantial distances from each other. Preferably, a first booster motor at the center of the roller line and a second booster motor at the end of the roller line opposite the gear transmissions can exert driving torque on the roller line.

What is claimed is:

1. A long spinning machine, preferably a ring spinning machine having at least one drive motor with a plurality of drawing means which serve to draw the fiber strands that are arranged next to each other at least on one side of the machine, with the driving lower rollers of each drawing means being formed by long roller lines, each of which roller lines extends along all of the drawing means of the long side of said machine, and further that the roller lines arranged on said long side of the machine are positively connected to each other at one point along the roller lines by drive gear transmissions thereby correlating the rpm relationships of the roller lines, the further improvement in which at least some of the roller lines of the drawing system that are arranged on the long side of the machine are positively connected with each other at least at one additional point spaced from said one point along the roller lines by additional drive gear transmissions and wherein all of said drive gear transmissions connected to the same roller lines have the same gear ratios and wherein the roller lines associated with the drawing fields having the greatest draft are connected with each other by a plurality of said drive gear transmissions.

2. A spinning machine according to claim 1, further wherein said roller lines are connected with each other by said drive gear transmissions at only two points spaced apart from each other which engage at points near the ends of said roller lines.

3. A spinning machine according to claim 2, further wherein said drive gear transmissions which engage at said two points along the roller lines connected by them are arranged at distances of about half of the roller line length from each other and of about one quarter of the roller line length from a free end of an adjacent roller line.

4. A spinning machine according to claim 1, further wherein all roller lines on the long side of the machine are connected at several points with each other by said drive gear transmissions.

5. A spinning machine according to claim 1, further wherein said roller lines on the long side of the machine include a single drive motor as common drive means.

6. A spinning machine according to claim 1, further wherein at least one drive gear transmission connection of the roller lines is provided between two drawing means.

7. A spinning machine according to claim 6, further wherein said roller lines are connected at their outer ends and at the center thereof by driving means.

8. A spinning machine according to claim 6, further wherein said ends of the roller lines are at least connected with each other by drive gear transmissions and another drive gear transmission is associated with these roller lines at a distance of about 0.6 to 0.7 times the length of the roller lines from each end.

9. A spinning machine according to claim 1, further wherein that a single electric motor serves to drive the roller lines.

10. A spinning machine according to claim 1, further wherein the drive of said roller lines has at least two motors, which operate on the roller lines at points spaced from each other.

11. A spinning machine according to claim 10, further wherein one of said at least two motors includes an electric motor which serves as the main drive of the roller lines and that the additional motors are booster motors which have less power than said main drive motor.

12. A spinning machine according to claim 10, further wherein all motors are connected with said roller line at the output end of the drawing machine and said drive gear transmissions are driven by said roller line.

13. A spinning machine according to claim 11, further wherein said drive roller lines opposite said gear transmissions are each connected with a booster motor.

14. A spinning machine according to claim 11, further wherein said booster motors are asynchronous electric motors.

15. A spinning machine according to claim 14, further wherein said booster motors include motors having a rotating magnetic field.

16. A spinning machine, comprising a ring spinning machine, with a plurality of drawing means which serves to draw the fiber strands in which said drawing means are arranged next to each other at least along one side of the machine, the lower rollers of which are formed by long driving roller lines that are connected to each other by drive gear transmissions, further wherein said drive gear transmissions which connect the roller lines are arranged medially of the drawing area of said spinning machine.

17. A spinning machine according to claim 16, further wherein said drive roller lines extend through said gear transmissions.

18. A spinning machine, comprising a ring spinning machine, with a plurality of drawing means which serve to draw the fiber strands which are arranged adjacent to each other on at least one side of the machine, further including driving lower rollers, each of which extends along all the drawing means of the long sides of said machine with the roller lines on one side of the machine being connected to each other by drive gear transmissions to thereby correlate the rpm ratios of the roller lines, further wherein at least one of said roller lines arranged on the long side of the machine concerned has a booster motor, which exerts a driving torque on said roller line at a distance from the drive gear transmissions to thereby reduce torsion therein during operation.

19. A spinning machine according to claim 18, further wherein said drive gear transmissions are associated with one of the ends of the roller lines.

20. A spinning machine according to claim 18, further wherein said booster motors are associated with the ends of the drive roller lines opposite the gear transmissions.

21. A spinning machine according to claim 20, further wherein said booster motors include shafts which are directly connected to each individual roller line.

* * * * *